United States Patent [19]

Woodrow

[11] Patent Number: 4,497,190

[45] Date of Patent: Feb. 5, 1985

[54] APPARATUS FOR BENDING A ROLLING MILL LAYING PIPE

[75] Inventor: Harold E. Woodrow, Northboro, Mass.

[73] Assignee: Morgan Construction Company, Worcester, Mass.

[21] Appl. No.: 531,234

[22] Filed: Sep. 12, 1983

[51] Int. Cl.[3] ..... B21D 7/02; B21D 11/06; B21F 3/02

[52] U.S. Cl. ..... 72/133; 72/135; 72/217; 72/306; 72/319

[58] Field of Search ..... 72/128, 133, 135, 137, 72/138, 139, 140, 142, 216, 217, 298, 305, 306, 319, 321

[56] References Cited

U.S. PATENT DOCUMENTS

| | | | |
|---|---|---|---|
| 1,628,581 | 5/1927 | Dinkel | 72/298 |
| 2,153,935 | 4/1939 | Neukirch | 72/217 |
| 2,228,448 | 1/1941 | Fader | 72/306 |
| 2,239,055 | 4/1941 | Sawyer | 72/139 X |
| 3,575,032 | 4/1971 | Zahuranec et al. | 72/217 X |
| 3,673,844 | 7/1972 | Heijenga et al. | 72/298 |
| 4,048,826 | 9/1977 | Lechner et al. | 72/142 X |

FOREIGN PATENT DOCUMENTS

| | | | |
|---|---|---|---|
| 2747844 | 5/1979 | Fed. Rep. of Germany | 72/128 |
| 426118 | 3/1935 | United Kingdom | 72/133 |

*Primary Examiner*—E. Michael Combs
*Attorney, Agent, or Firm*—Thompson, Birch

[57] ABSTRACT

A method and apparatus for imparting a three-dimensionally curved configuration to a straight elongated element wherein one end of the element is removably supported with its axis coincident with a reference axis. The element is partially pre-bent away from the reference axis into conformity with a two-dimensional first guide path. Thereafter, the pre-bent element is bent into conformity with a three-dimensional helical second guide path.

14 Claims, 17 Drawing Figures

APPARATUS FOR BENDING A ROLLING MILL LAYING PIPE

BACKGROUND OF THE INVENTION

1. Field of the Invention

This invention relates generally to bending fixtures, and is concerned in particular with the provision of an improved method and apparatus for bending laying pipes for use in the laying heads of rod and bar rolling mills.

2. Description of the Prior Art

In one conventional laying pipe bending operation, an entire straight length of pipe is preheated and then manually bent and clamped along a single three dimensionally curved guide path. This operation requires a team of experienced mill personnel who must work quickly and in a carefully coordinated manner. In another conventional operation, the pipe is preheated, section by section, with each section again being manually bent and clamped along a single three dimensionally curved guide path. This operation requires considerable time, thereby limiting production to a few pipes per day. Moreover, both operations require mill personnel who must possess considerable skill and dexterity. The working conditions are relatively hazardous in that the mill personnel are intimately exposed to radiant heat from the heated pipe. Moreover, the results of the bending operation are likely to be unsatisfactory. For example, the pipe may not take on the precise three dimensional configuration being sought, or portions of the pipe may be cross-sectionally deformed.

Where such defects are pronounced and readily discernable, the pipe will be scrapped before being mounted for operation in a mill laying head. Here, the mill owner's loss is limited to the cost of the pipe and the unsuccessful bending operation. On the other hand, where the defects are not readily discernable, they may not be noticed until after the pipe is installed and running. Here, the mill owner's loss will be additionally compounded by ruined product and costly lost production time.

SUMMARY OF THE INVENTION

The object of the present invention is to provide an improved method and apparatus for consistently and reliably bending a rolling mill laying pipe into the desired three dimensionally curved configuration, without having to rely unduly on the experience, skill, dexterity and coordination of mill personnel.

To this end, the present invention provides a bending jig having a holder adapted to removably receive and support one end of a straight pipe section, with the axis of the pipe being coincident with a reference axis. Before being placed in the holder, the pipe is preheated to an elevated bending temperature. The bending jig further includes a guide defining a two-dimensional curved first bending path leading away from the reference axis, and another guide defining a three-dimensional helical second bending path also leading away from the reference axis. The pipe is initially pre-bent away from the reference axis along the first bending path. Then, the pre-bent pipe is bent into conformity with the helical second path.

The entire operation can be carried out quickly, with consistent predictable results, and with a minimum exposure of the mill personnel to radiant heat from the preheated pipe.

These and other features, advantages and objectives of the present invention will be described in greater detail with reference to the accompanying drawings wherein:

DETAILED DESCRIPTION OF THE INVENTION

Figure 1:
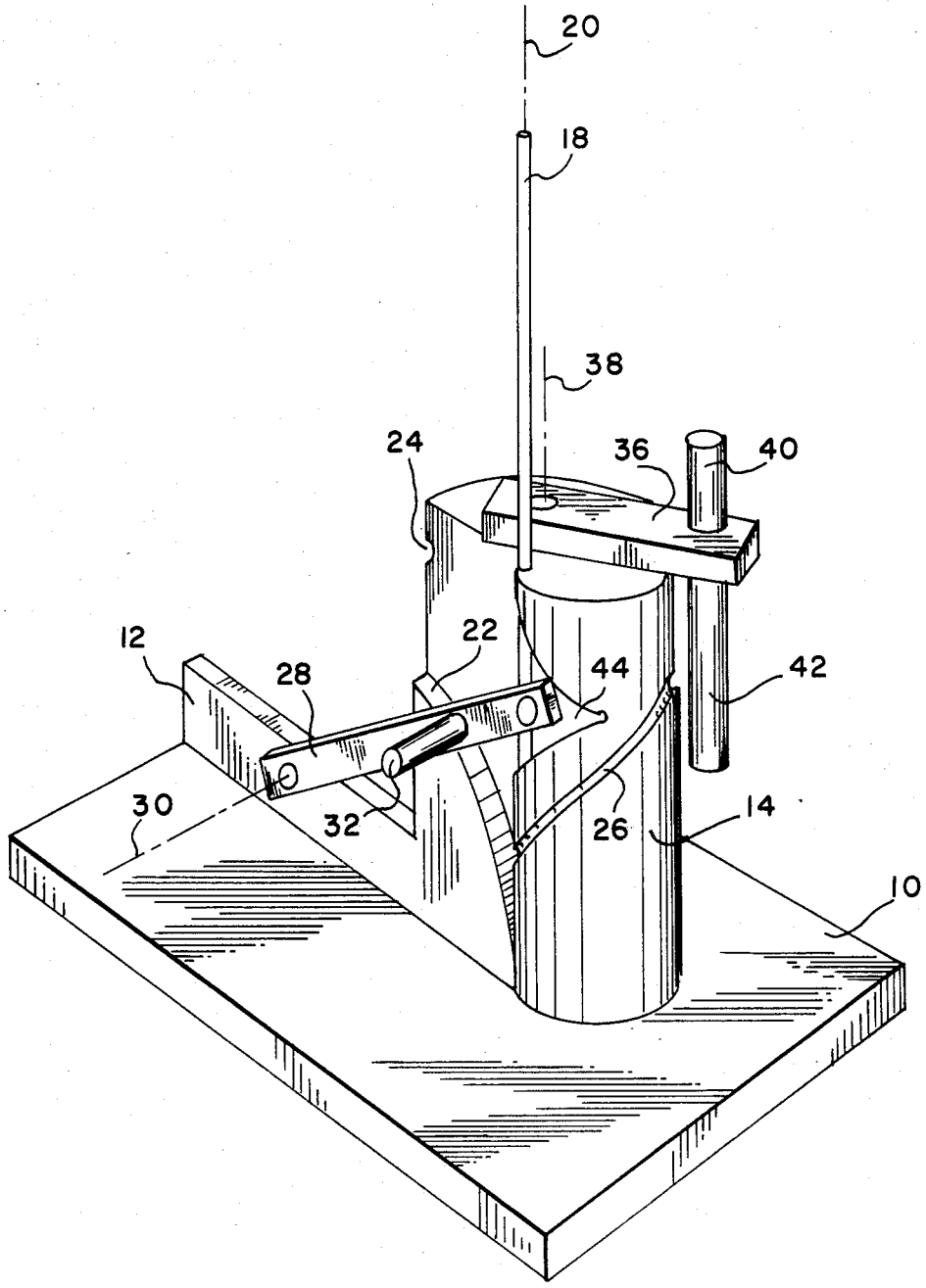
FIG. 1 is a perspective view showing one embodiment of an apparatus in accordance with the present invention at the outset of a bending operation.
Figure 2:
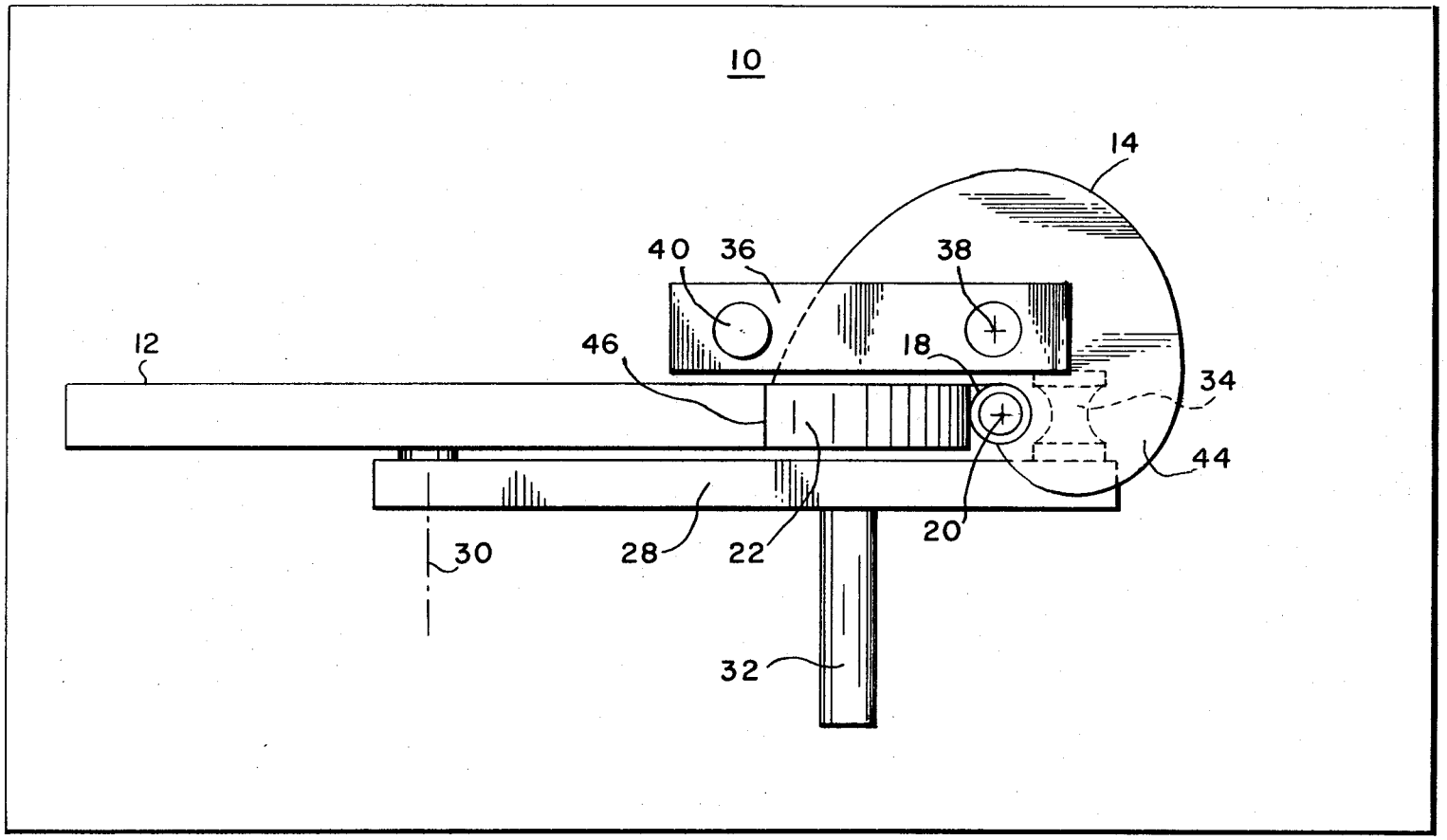
FIGS. 2 and 3 are plan and side elevational views respectively on an enlarged scale of the apparatus as it appears in FIG. 1.
Figure 3:
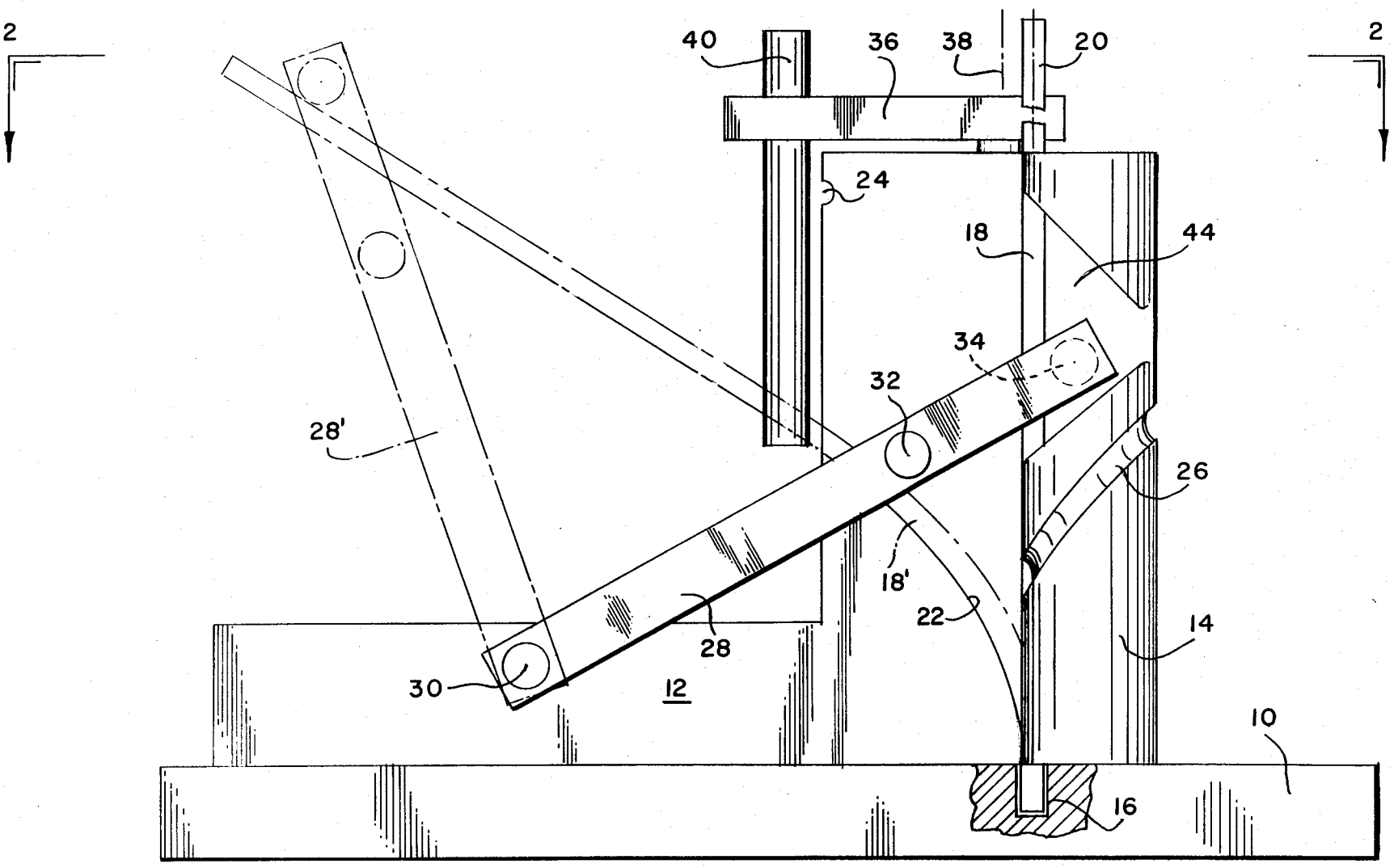

Referring initially to FIGS. 1–3, one embodiment of an apparatus in accordance with the present invention is shown comprising a base 10 supporting first and second fixed guide members 12, 14. The base is drilled or otherwise adapted to provide a holder 16 for removably receiving and retaining one end of a straight pipe section 18, with the longitudinal axis of the pipe section being coincident with a reference axis 20.

The first guide member 12 defines a two-dimensional first bending path 22 curving away from the reference axis 20. The second guide member has a surface groove 24 defining a helical second bending path 26 which also curves away from the reference axis 20.

A first bending means in the form of a lever 28 is mounted on the first guide means 12 for rotation about a first axis 30. The lever 28 has a handle 32 and a pipe engaging roller 34.

A second bending means in the form of another lever 36 is mounted on the second guide member 14 for rotation about a second axis 38. Lever 36 also has a handle 40 and a pipe engaging leg 42. The second guide member is relieved as at 44 to provide clearance for the roller 34 when the handle 32 is rotated to its start position as shown by the solid lines in FIGS. 1–3. Likewise, the first guide member 14 terminates at 46 to allow the pipe engaging leg 42 of lever 36 to swing across the first bending path 22. The axes 30, 38 are non-parallel, with the axis 38 being parallel to the reference axis 20.

In carrying out a bending operation with this embodiment, the entire pipe section 18 is initially preheated to an elevated bending temperature. By way of an example, where the laying pipe consists of alloy steel ASTM A335 Grade P-22, the bending operation should start at about 980° C. and finish at about 740° C. After being suitably preheated, one end of the pipe section is removably inserted in the holder 16, with the longitudinal axis of the pipe section thus being held coincident with the reference axis 20.

Figure 4:
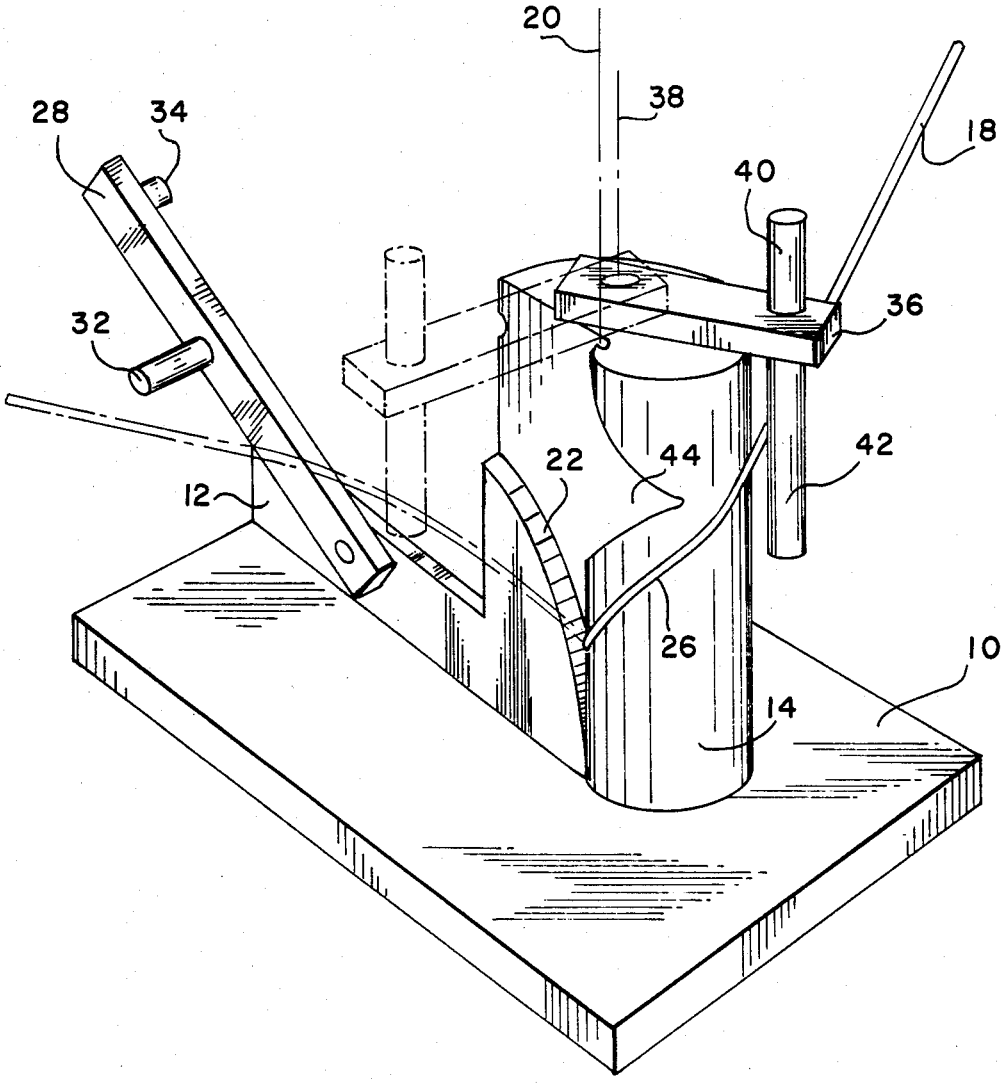
FIG. 4 is a perspective view similar to FIG. 1 showing the apparatus in a subsequent stage of the bending operation.

The first lever 28 is then rotated about the first axis 30 in a counterclockwise direction as viewed in FIG. 3, from its start position as shown by the solid lines in FIGS. 1–3, to a finish position as shown by the dot-dash lines at 28' in FIG. 3. During this rotation, the roller 34 engages the pipe section and permanently deforms a portion of the same against the first bending path 22 into the two-dimensional pre-bent shape indicated at 18'. The lever 28 is then detached from the guide member 12, and the second lever 36 is rotated about axis 38 in a counterclockwise direction as viewed in FIG. 1. As the depending leg 42 moves across the plane of guide member 12, it engages the pre-bent pipe section and causes the same to begin rotating about reference axis 20, as shown by the dot-dash lines in FIG. 4. This rotation about reference axis 20 will continue until the pre-bent pipe section comes into contact with the innermost portion of the groove 24 defining the helical second bending path 26. Thereafter, as the lever 36 continues its counterclockwise rotation about the second axis 38, the depending leg 42 acts on the pipe section to permanently deform the same into the groove 24 in conformity with the helical second bending path. The solid lines in FIG. 4 show this final bending operation in progress.

Figure 9:
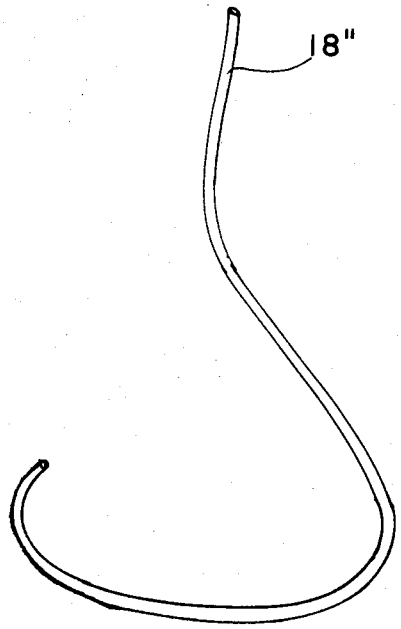
FIG. 9 is a perspective view of a laying pipe formed in accordance with the present invention.
Figure 10:
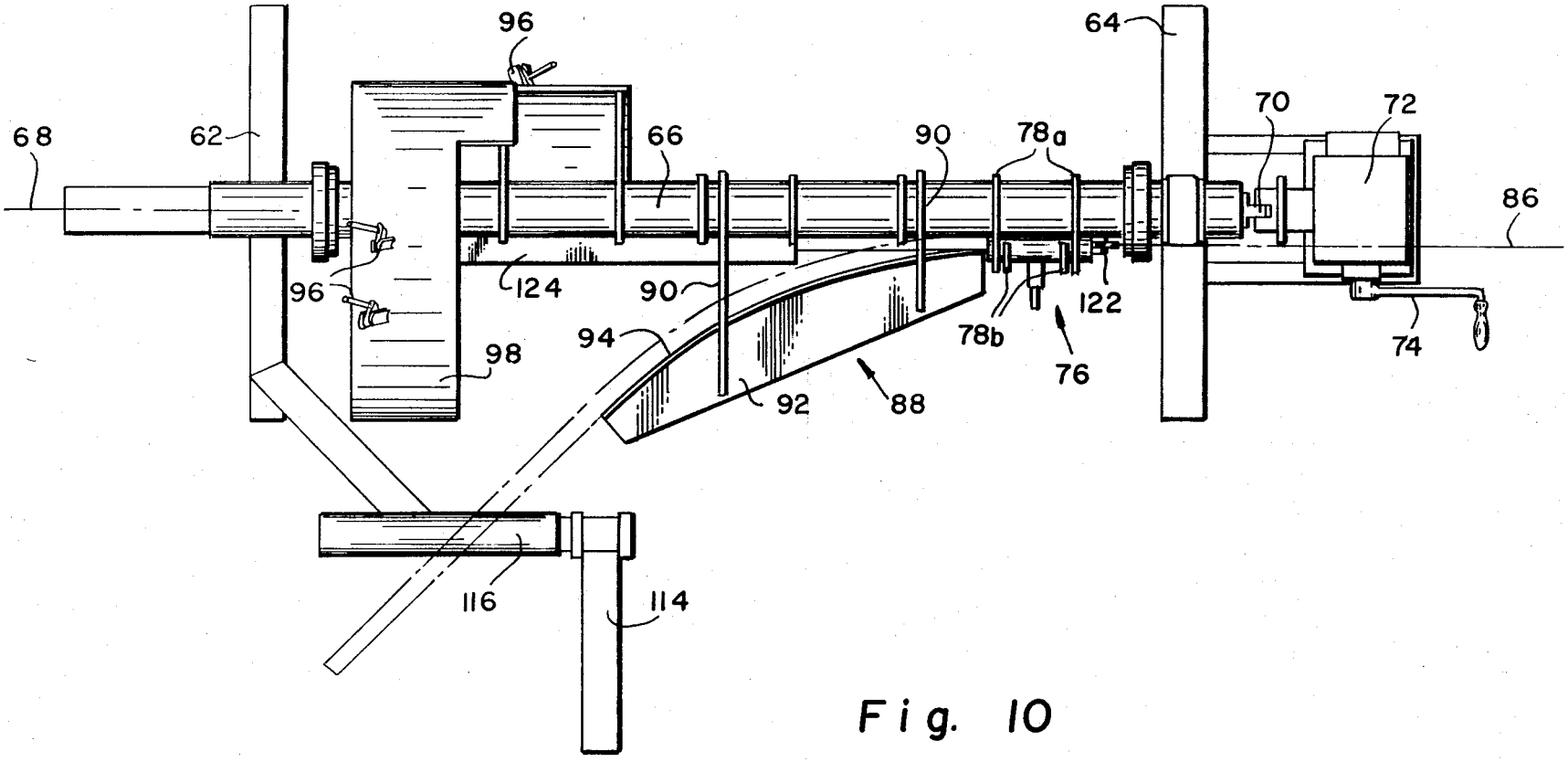
FIG. 10 is plan view of an alternate embodiment of an apparatus in accordance with the present invention.
Figure 11:
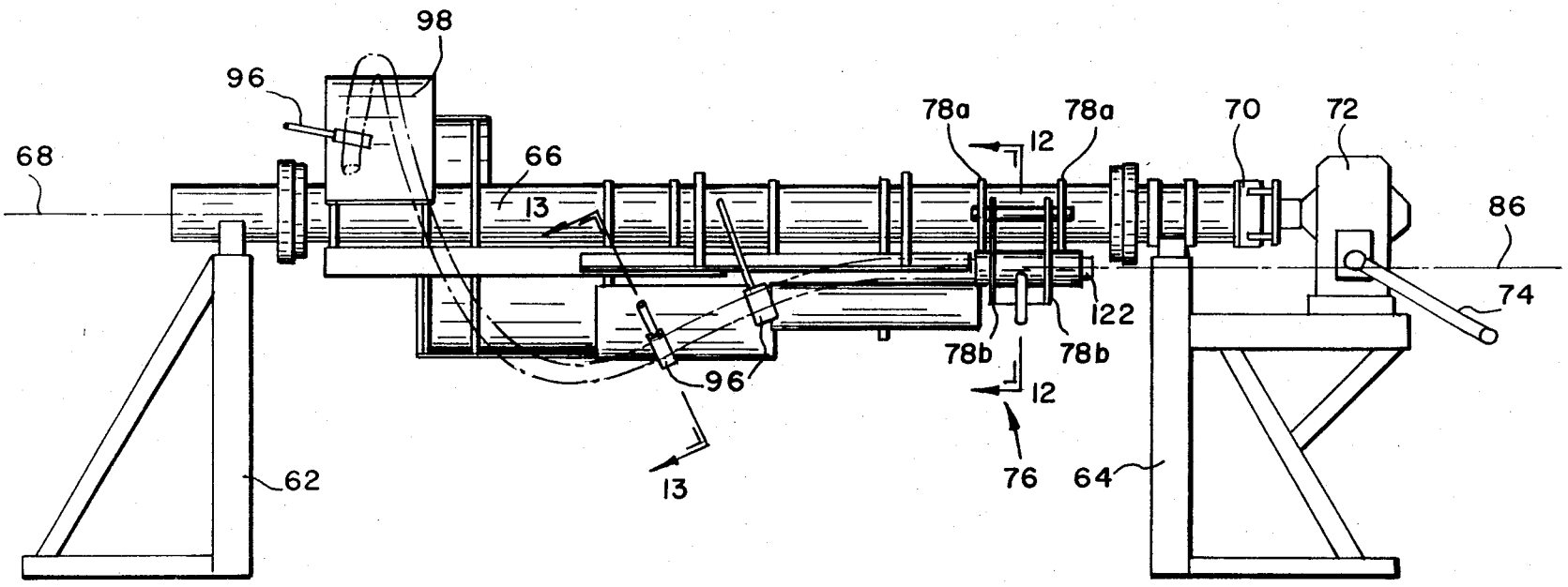
FIG. 11 is a view in side elevation of the apparatus shown in FIG. 10.

After completion of the second bending stage, the pipe is allowed to cool to a temperature at which it can be safely handled. The pipe section is then removed from the apparatus and trimmed to a finish length. The resulting three dimensionally curved piece is shown at 18" in FIG. 9.

Figure 5:
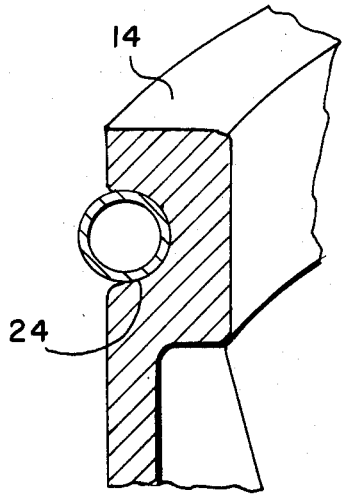
FIG. 5 is a sectional view through the upstanding second guide, showing the cross-sectional shape of the helical guide groove.
Figure 6:
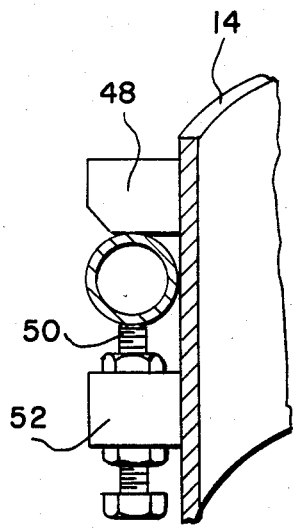
FIGS. 6, 7 and 8 are views similar to FIG. 5 showing alternative means for defining the helical guide path.

With the above in mind, numerous changes and modifications will undoubtedly occur to those skilled in the art. For example, as shown in FIGs. 1–4 and in particular in FIG. 5, the helical second bending path can be defined by a surface groove 24 in the second guide member 14. Alternatively, however, as shown in FIG. 6, the helical second bending path can be defined by a first series of brackets 48 which are fixed to the surface of the second guide member 14, and which are arranged to cooperate with associated bolts 50 adjustably carried on a second series of brackets 52.

Figure 7:
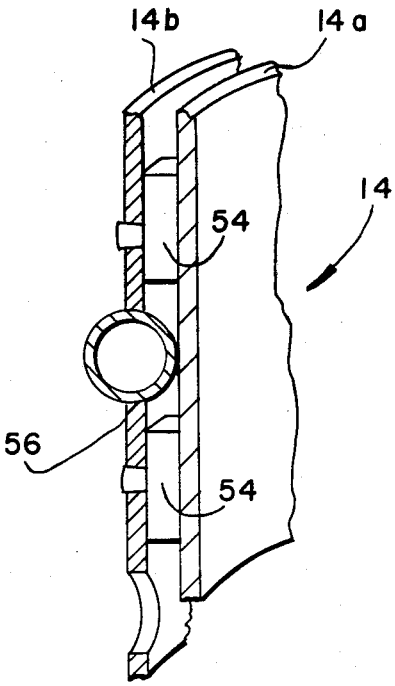

Still another arrangement is shown in FIG. 7 where, the second guide member 14 consists of inner and outer plates **14*a*, 14*b* held in spaced relationship by spacers 54, with the helical second bending path being defined by a slit 56 in the outer plate 14*b***.

Figure 8:
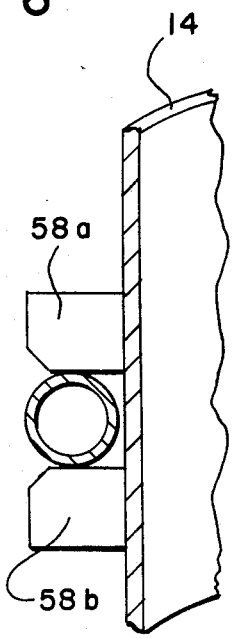

Yet another arrangement is shown in FIG. 8, where the helical second bending path can be defined by a first and second series of bracelets **58*a*, 58*b*, which are fixed to the surface of the second guide member 14**.

The design and manner of manipulating the levers 28 and 30 also can be varied to suit particular requirements. For example, it might be desirable to hydraulically or electrically drive the levers, and to automatically control their movements.

Referring now to FIGS. 10–17, a second embodiment of the invention is shown comprising spaced pedestals 62, 64 carrying suitable bearings between which an elongated generally tubular fixture 66 is supported for rotation about an axis 68. The fixture 66 is connected at one end as at 70 to the output shaft of a gear box 72. The gear box is manually driven by a handle 74, the rotation of which causes the fixture 66 to rotate about axis 68.

A holder generally indicated at 76 is carried on the fixture 66 for rotation therewith. The holder comprises a pair of brackets **78*a* fixed to and spaced axially along the fixture 66. The brackets carry one half 80*a* of a split tube. The other half 80*b* of the split tube is carried by a pair of brackets 78*b* which are pivotably connected to the brackets 78*a* by means of a cross pin 82. The tube half 80*b* and its brackets 78*b* are pivotable between an open position as shown by the dot-dash lines in FIG. 12, and a closed position shown by the solid lines and at which they are held by any convenient manually releasable locking mechanism such as that generally indicated at 84. When in the closed position, the tube half sections 80*a*, 80*b* cooperate in defining a tubular enclosure lying on a reference axis 86. The reference axis 86 is parallel to the rotational axis 68 of the fixture 66**.

A first guide generally indicated at 88 is mounted on the fixture 66 at a location directly adjacent to the holder 76. As can be best seen in FIG. 10, the first guide includes brackets 90 extending radially from the fixture to support a guide plate 92, the inner edge of which defines a two-dimensional first guide path 94.

The fixture 66 also carries a second guide in the form of a plurality of discrete pipe clamps indicated typically at 96 and arranged in a three-dimensional helical configuration. At the large diameter end of the helix, the clamps 96 are mounted on a support skirt 98 carried on the fixture 66.

Figure 13:
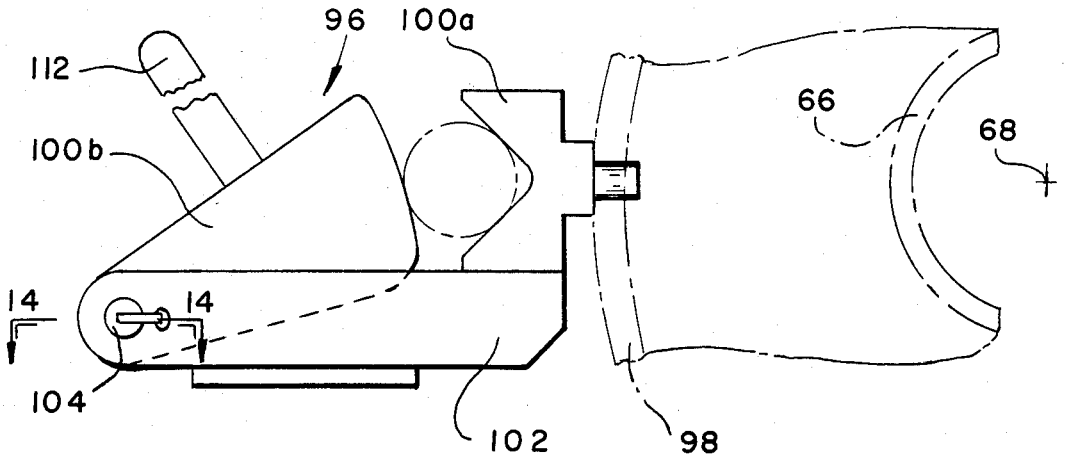
FIGS. 12 and 13 are sectional views on an enlarged scale taken respectively along lines 12—12 and 13—13 of FIG. 11.
Figure 14:
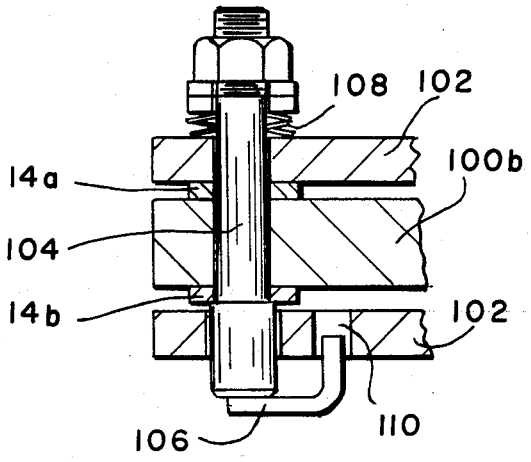
FIG. 14 is a sectional view taken along line 14—14 of FIG. 13.
Figure 12:
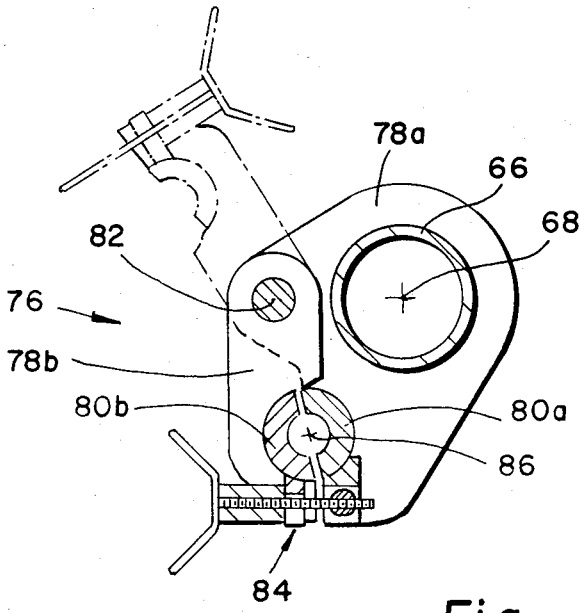

One such typical pipe clamp is shown in FIGS. 13 and 14 as comprising a fixed jaw element **100*a* which cooperates with a movable jaw element 100*b* pivotally attached between a pair of support brackets 102 by means of a cross pin 104 carrying a finger 106. The movable jaw element is squeezed between washers 107*a* and 107*b* by means of a spring 108 so as to provide frictional resistance to prevent opening of clamp 96 when in an inverted attitude. Cross pin 106 is contained in a locating aperture 110 to prevent rotation of cross pin 104 thus maintaining pressure adjustment of spring 108. The movable jaw element may be moved between open and closed positions by means of a handle 112 having mechanical advantage over spring 108**.

A third pedestal 114 is arranged to one side of the fixture 66. Pedestal 114 carries a roller 116 overlying an arm 118 with a stop 120 thereon.

Figure 15:
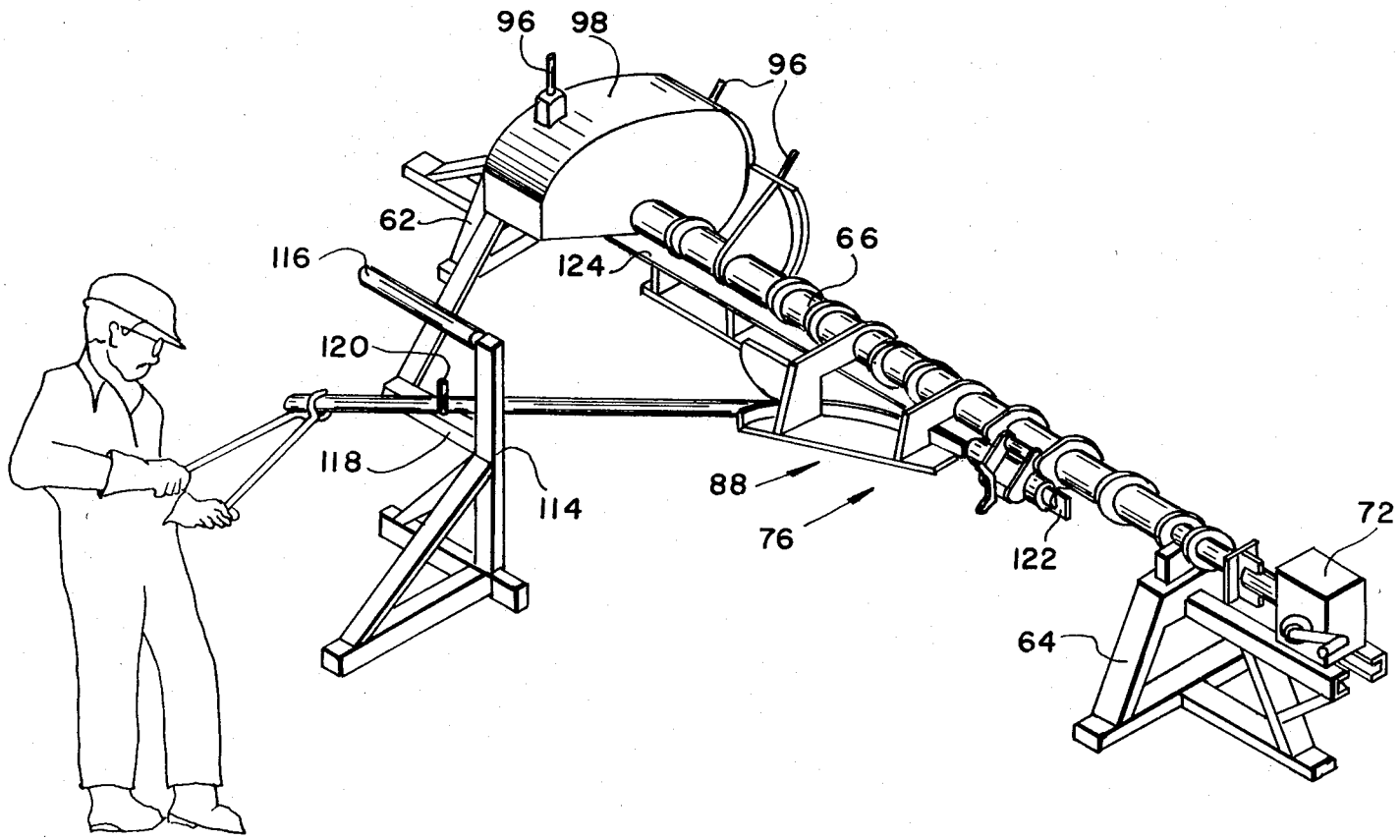
FIGS. 15–17 are perspective views showing the apparatus at different stages during a pipe bending operation.

The operation of the apparatus will now be described with particular reference to FIGS. 15–17. The pipe clamps 96 and holder 76 are first opened. One end of a preheated pipe section is inserted into the open holder 76. A stop 122 locates the end of the pipe, and an angle guide 124 assists in temporarily supporting the remainder of the pipe section. The holder 76 is closed, after which a portion of the pipe is manually pre-bent against the first guide 88, as shown in FIG. 15. The stop 120 on arm 118 limits the extent of this initial bending operation. The free end of the pipe section now is supported on the arm 118 at a location underlying the roller 116.

Figure 16:
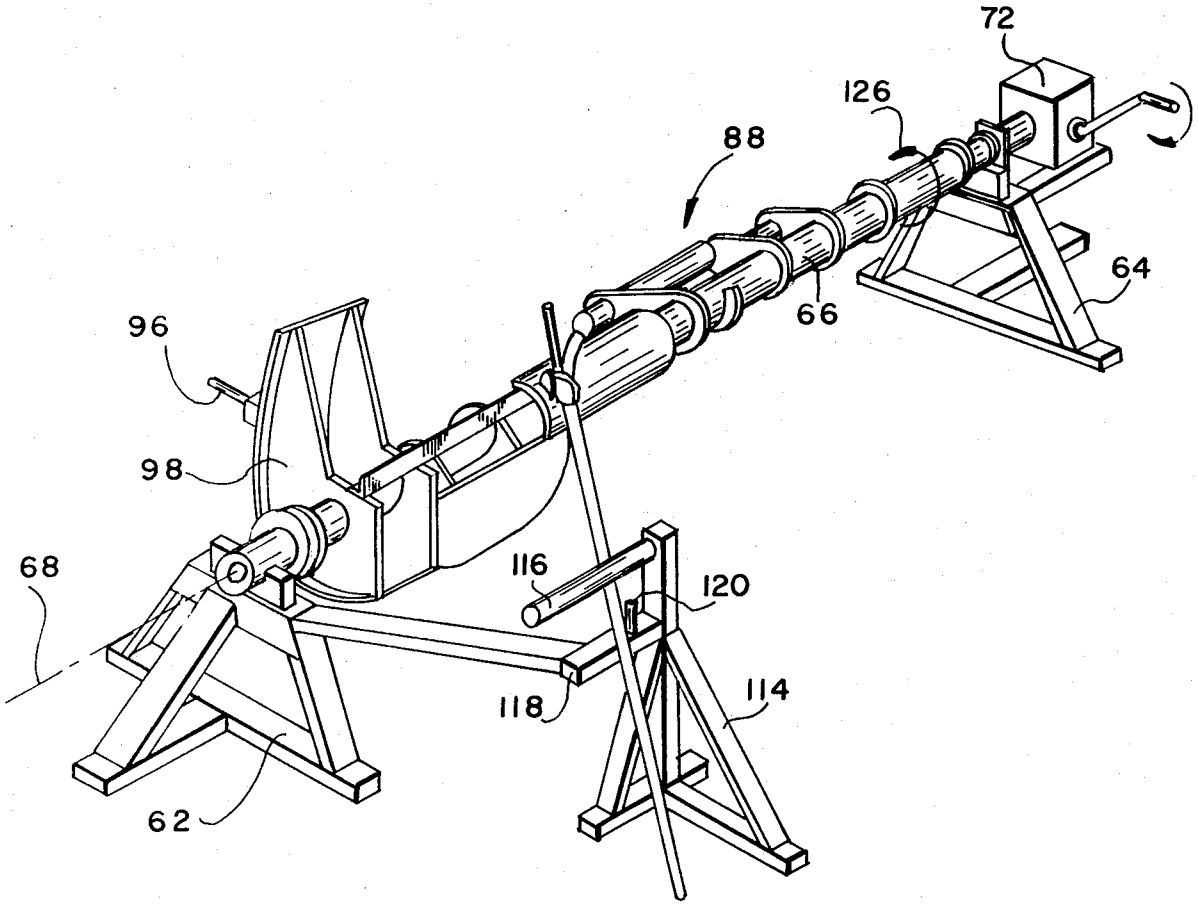
Figure 17:
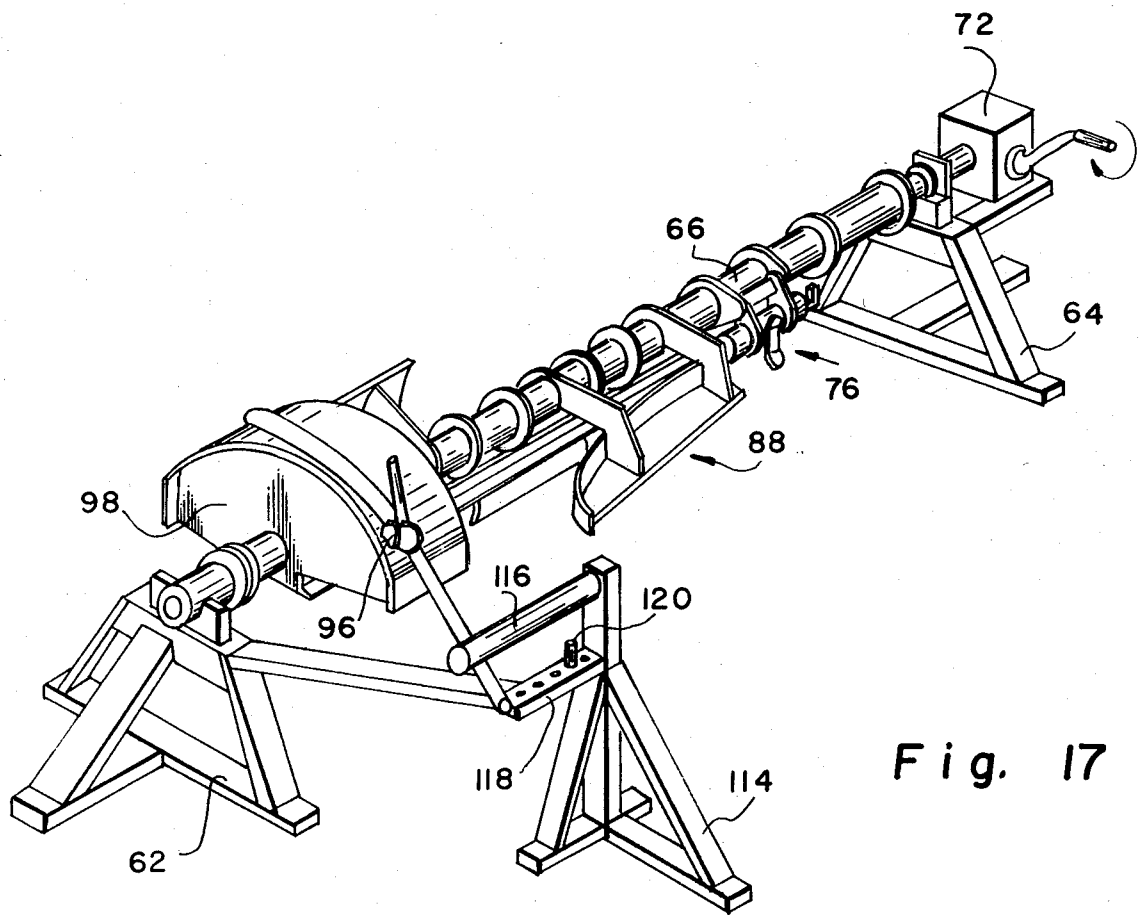

The fixture 66 is then rotated in the direction indicated by arrow 126 in FIG. 16, causing the pre-bent pipe to orbit about axis 68. The free end of the pipe section is lifted into contact with and is thereafter restrained from further rotation by the roller 116. Thus, as the fixture 66 continues to rotate, the pipe section is gradually wrapped into conformity with the three-dimensional helical path defined by the fixed jaw section 100*a*. As the pipe section seats itself in the fixed jaw section 100*a* of each clamp, the clamp is immediately closed. The end of the bending operation is shown in FIG. 17. All clamps 96 remain closed until the pipe section has cooled sufficiently. Thereafter, the clamps 96 and holder 76 are opened and the pipe section, now bent into the desired three-dimensional helical shape, is removed and trimmed.

It will thus be appreciated by those skilled in the art that with either of the above-described ambodiments of the present invention, a two-stage bending operation can be carried out in a minimum amount of time, by operating personnel who do not require specialized training and coordination. The resulting pipes are precisely and consistently formed with a minimum exposure of personnel to radiant heat.

It is my intention to cover these as well as any other embodiments and changes and/or modifications thereto which do not depart from the scope of the appended claims.

I claim:

1. Apparatus for bending a rolling mill laying pipe, comprising:

a holder for removably retaining one end of a straight pipe section, with the axis of said pipe section being coincident with a reference axis;

first guide means defining a two dimensional first bending path curving away from said reference axis and along which a portion of the thus retained pipe section may be pre-bent and permanently deformed into conformity with said first bending path; and second guide means defining a three-dimensional helical second bending path curving away from said reference axis and along which the thus retained and pre-bent pipe section may be bent and permanently deformed into conformity with said second bending path.

2. The apparatus of claim 1 further comprising first bending means rotatable about a first axis and being engageable with the thus retained straight pipe section to pre-bend and permanently deform said portion of said pipe section against said first guide means, and second bending means rotatable about a second axis and being engageable with the thus retained and pre-bent pipe section to deform the same against said second guide means.

3. The apparatus of claim 2 wherein said first axis is nonparallel to said reference axis.

4. The apparatus of claims 2 or 3 wherein said second axis is parallel to said reference axis.

5. The apparatus of claim 2 wherein said first and second bending means comprise rotatable levers, each having a pipe engaging arm protruding therefrom.

6. The apparatus of claim 1 further comprising a rotatable fixture, said holder being mounted on said fixture for rotation therewith, with said reference axis being parallel to the rotational axis of said fixture, whereupon a pipe section retained by said holder will be moved in an orbital path about said axis during rotation of said fixture, and means for rotating said fixture.

7. The apparatus of claim 6 wherein said first guide means is carried on said fixture for rotation therewith.

8. The apparatus of claims 6 or 7 wherein said second guide means is carried on said fixture for rotation therewith.

9. The apparatus of claim 8 further comprising stationary means extending across the orbital path of the thus retained and pre-bent pipe section, said stationary means being adapted to act in concert with the rotation of said fixture to further bend and permanently deform said pre-bent pipe section against said second guide means.

10. The apparatus of claim 8 wherein said second guide means comprises a plurality of discrete guide elements arranged in a helical formation surrounding said rotational axis.

11. The apparatus of claim 10 further comprising clamp means for releasably holding said pipe section against said guide elements.

12. Apparatus for bending a rolling mill laying pipe, comprising:

a holder for removably retaining one end of a straight pipe section, with the axis of said section being coincident with a reference axis;

first guide means defining a two-dimensional first bending path curving away from said holder and said reference axis;

second guide means defining a three-dimensional helical second bending path curving away from said holder and said reference axis;

a first bending means rotatable about a first axis and being engageable with said straight pipe section to pre-bend and permanently deform a portion of the same into conformity with said first bending path, said first axis being nonparallel to said reference axis; and a second bending means rotatable about a second axis and being engageable with said retained and pre-bent pipe section to bend and permanently deform the same into conformity with said second bending path, said second axis being parallel to said reference axis.

13. Apparatus for imparting a three-dimensionally curved configuration to a straight elongated element comprising:

holder means for removably retaining one end of said element at a fixed location;

first bending means rotatable about a first axis for pre-bending at least a portion of said element along a two-dimensional first guide path leading away from said fixed location; and second bending means rotatable about a second axis nonparallel to said first axis for bending said retained and pre-bent element along a helical second guide path leading away from said fixed location.

14. Apparatus for bending a rolling mill laying pipe, comprising:

a rotatable fixture;

means for rotating said fixture;

a holder mounted on said fixture for rotation therewith, said holder being structured to removably retain one end of a straight pipe section with the axis of said straight pipe section being coincident with a reference axis which is parallel to the rotational axis of said fixture, whereupon rotation of said fixture will cause the thus retained pipe section to orbit about said rotational axis;

first guide means carried on said fixture for rotation therewith, said first guide means defining a two-dimensional first bending path curving away from said reference axis and along which a portion of the thus retained pipe section may be pre-bent and permanently deformed into conformity with said first bending path;

second guide means carried on said fixture for rotation therewith, said second guide means defining a three-dimensional second bending path curving away from said reference axis and along which the thus retained and pre-bent pipe section may be bent and permanently deformed into configuration with said second bending path; and stationary means arranged to be encountered by the thus retained and pre-bent pipe section during the orbiting thereof about said rotational axis, said stationary means being positioned to act in concert with the rotation of said fixture to further bend and permanently deform said pipe section along said second path.

* * * * *